United States Patent [19]

Harvill

[11] 4,272,968

[45] Jun. 16, 1981

[54] CONVERTIBLE DISPENSER

[75] Inventor: William A. Harvill, Stone Mountain, Ga.

[73] Assignee: The Coca-Cola Company, Atlanta, Ga.

[21] Appl. No.: 56,270

[22] Filed: Jul. 10, 1979

[51] Int. Cl.[3] ..... B67D 5/62; F25D 19/02

[52] U.S. Cl. ..... 62/394; 62/390; 62/448; 165/133

[58] Field of Search ..... 62/332, 333, 334, 398, 62/400, 394, 395, 448, 457, 326; 222/146; 165/133, 134; 264/196, 129, 60

[56] References Cited

U.S. PATENT DOCUMENTS

| | | | |
|---|---|---|---|
| 1,662,267 | 3/1928 | Horner | 62/398 |
| 1,754,377 | 4/1930 | Tower | 62/398 |
| 1,895,085 | 1/1933 | Peltier | 62/448 |
| 2,030,554 | 2/1936 | Van Sciver | 62/448 |
| 2,063,171 | 12/1936 | Kucher | 62/390 |
| 2,306,714 | 12/1942 | Rowell | 62/390 X |
| 2,508,289 | 5/1950 | Peck | 62/448 |
| 2,673,005 | 3/1954 | Brown | 62/390 X |
| 2,923,640 | 2/1960 | Buckingham et al. | 165/133 X |
| 2,929,228 | 3/1960 | Gould, Jr. | 62/398 X |
| 3,011,323 | 12/1961 | Jaeger | 62/390 X |
| 3,203,404 | 8/1965 | Miller | 165/133 X |
| 3,331,536 | 7/1967 | De Lorenzo | 62/398 |
| 3,422,634 | 1/1969 | Brown | 62/394 |
| 3,462,970 | 8/1969 | Natter | 62/394 |
| 3,464,228 | 9/1969 | Hitchcock | 62/448 |

*Primary Examiner*—Lloyd L. King

*Attorney, Agent, or Firm*—Birch, Stewart, Kolasch and Birch

[57] ABSTRACT

The present invention is directed to a post-mix or pre-mix dispenser for soft drinks including a cooling tank which can either be filled with particles of ice for cooling the beverage to be dispensed or operated with a mechanical refrigeration system including a compressor and a cooling fluid which is circulated through cooling coils extending into the tank. The mechanical refrigeration system, when in use, is inserted through an upper opening in the cooling tank and forms the closure of the tank when in place. When particles of ice are used as a cooling medium, they are also inserted through the upper opening in the cooling tank and a conventional closure would then be placed over the opening of the tank.

4 Claims, 6 Drawing Figures

CONVERTIBLE DISPENSER

BACKGROUND OF THE INVENTION

1. Field of the Invention

The present invention relates to a cooling mechanism for a post-mix or pre-mix dispenser which may employ mechanical refrigeration or may be operated with particles of ice for cooling the beverage to be dispensed.

2. Description of the Prior Art

Many exemplary cooling systems for a post-mix or pre-mix dispenser for soft drinks are available in the prior art. However, these systems are usually designed to cool the beverage by either a mechanical refrigeration system which is designed to be used as the only cooling means for the beverage dispensing system or by means of an ice-cooled system which is designed to be used as the only cooling means for the beverage dispensing system.

It is conventional in an ice-cooled system to position a heat exchanger in contact with a supply of ice. However, this system is not designed to alternatively be used in combination with a mechanical refrigeration system.

Brown, U.S. Pat. No. 3,422,634, discloses a beverage dispenser in which a tank 36 is cooled by means of a mechanical refrigeration system 40. A coil assembly 60 is positioned around the vertical walls of the tank 36 and is designed to contain six product coils for cooling six separate beverage products. The mechanical refrigeration system 40 is positioned on legs 46 which enable the correct positioning of the refrigeration system within the tank 36. Further, the refrigerating unit 40 is designed to be removed from the dispenser assembly for servicing and the legs 46 will function to support the unit in a vertical position on a flat surface with the refrigerating coils protected and supported in a vertical position. This beverage dispenser is designed to work as a unit with the mechanical refrigeration system in place as the only cooling means for the beverage dispensing system. Thus, when the mechanical refrigeration system is removed, the dispenser can not function.

Another prior art beverage dispenser is disclosed by Schroeder, U.S. Pat. No. 3,892,335. Schroeder discloses a dispenser for dispensing cool beverages which includes a tank portion 16 and a cooling unit 15. The cooling unit 15 is designed to be removed from the tank portion 16 by merely loosening the bolts 21. Again, the cooling unit and the tank are designed to work together and it is not contemplated to operate the beverage dispenser disclosed in Schroeder without the cooling unit 15 in place. However, even if ice was positioned in the tank portion 16 the system would not adequately cool the coils to permit the beverage to be satisfactorily dispensed from the dispensing valves.

SUMMARY OF THE INVENTION

A primary object of the present invention is to provide a convertible beverage dispenser wherein the cooling system may be readily interchanged between a mechanical refrigerating system and a system which incorporates particles of ice only.

A further object of the present invention is to provide a convertible beverage dispensing system which includes a heat exchanger positioned in the lower portion of the tank which may be cooled by either a mechanical refrigeration system or by means of particles of ice.

A still further object of the present invention is to provide a convertible beverage dispensing system wherein the heat exchanger is positioned in the lower portion of a cooling tank and is made as a unitary, liquid-tight structure therewith.

Another object of the present invention is to provide a convertible beverage dispensing system wherein the heat exchanger is constructed of aluminum, and side walls which form a unitary structure with the heat exchanger are similarly formed of aluminum.

It is a further object of the present invention to provide a mechanical refrigerating system which includes a copper coil which projects downwardly into the cooling tank which is coated with an epoxy to prevent galvanic corrosion between the copper cooling coil and the aluminum tank and heat exchanger.

These and other objects of the present invention are accomplished by providing a convertible beverage dispensing system which includes a heat exchanger positioned in the lower most portion thereof and including side walls integrally attached thereto which form a liquid-tight cooling tank. The cooling tank may be filled with water or other cooling fluid and permits a heat transfer between the heat exchanger positioned in the lowermost portion thereof and a cooling coil of a mechanical refrigerating unit positioned within the cooling tank. Further, the mechanical refrigerating unit may be removed from the cooling tank and replaced with particles of ice which will function in the same manner as the cooling coil of the mechanical refrigeration unit.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
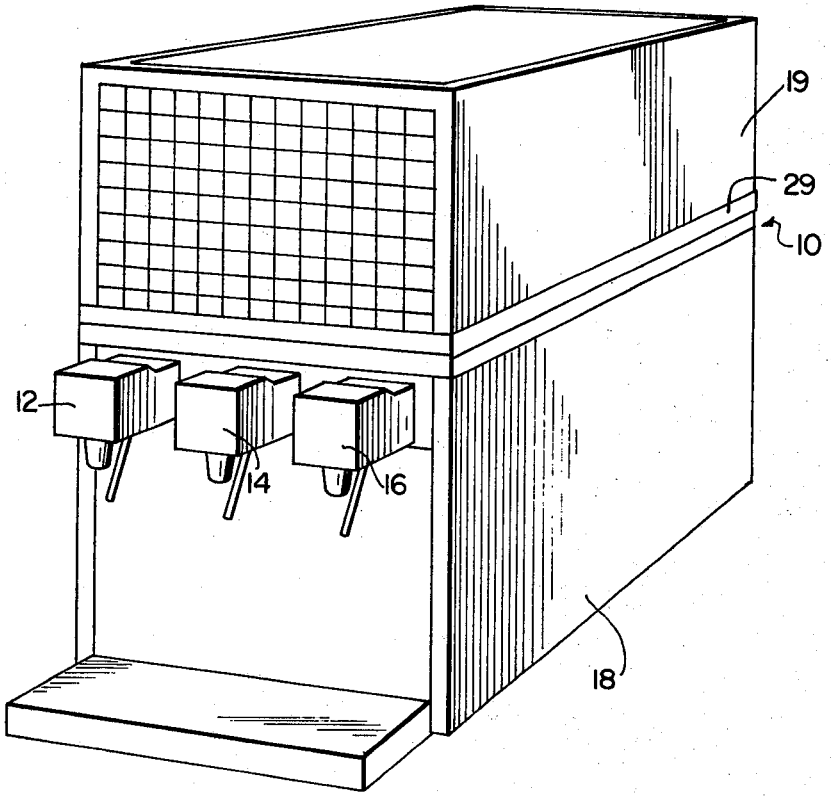
FIG. 1 is a perspective view of the convertible beverage dispenser of the present invention shown in combination with a mechanical refrigeration system.
Figure 3:
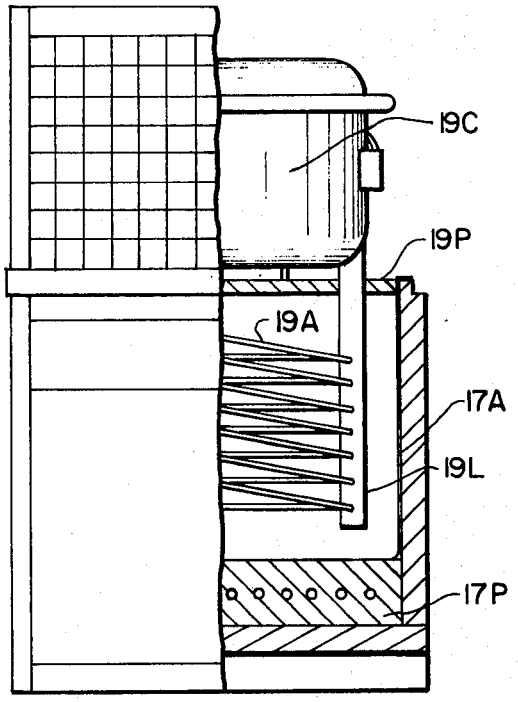
FIG. 3 is a partial cross-sectional view of the convertible beverage dispenser illustrated in FIG. 1.

Referring to FIGS. 1 and 3, there is illustrated a convertible beverage dispenser according to the present invention which includes a mechanical refrigeration system positioned within a housing mounted on the uppermost portion of the beverage dispenser. The convertible beverage dispenser 10 includes three or four valves 12, 14 and 16 for dispensing a liquid product therefrom. The three or four valves are individually connected to beverage containers which are positioned adjacent to the counter on which the beverage dispenser 10 is positioned. As is conventional in this art, the product positioned within the container is cooled as it passes through the beverage dispenser before it is discharged from one of the dispensing valves 12, 14 or 16.

Figure 4:
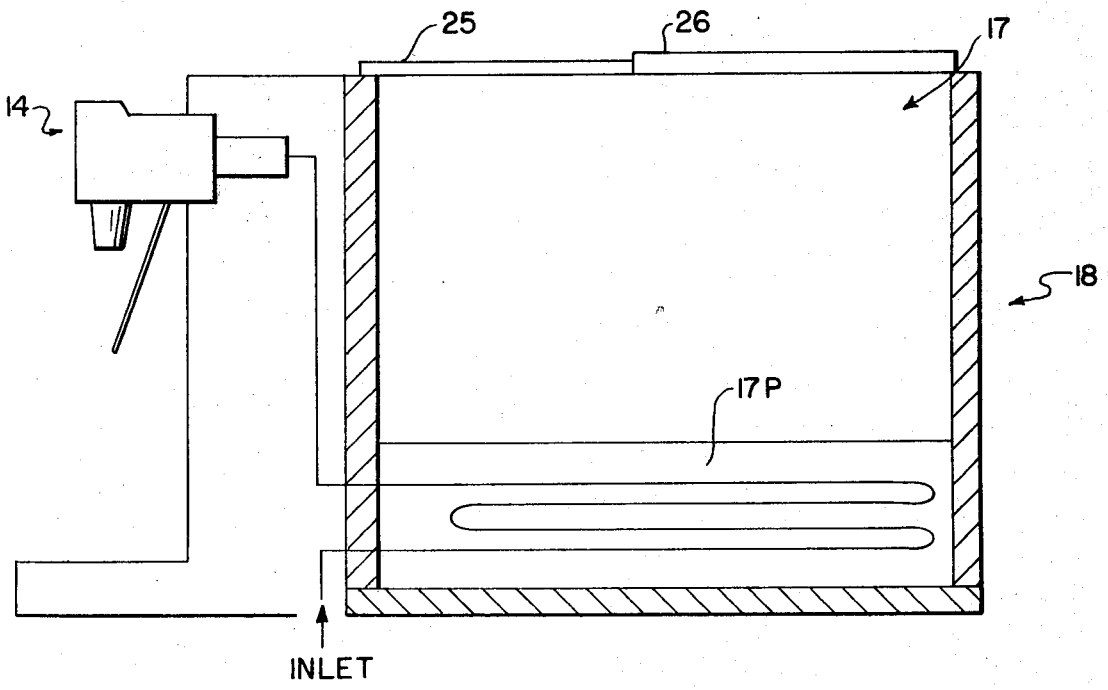
FIG. 4 is a cross-sectional view showing the preferred construction of the convertible beverage dispenser as illustrated in FIG. 2.

As illustrated in FIGS. 3 and 4, the convertible beverage dispenser 10 includes a sealed cooling tank 17 into which a cooling coil 19A of a mechanical refrigerating system 19 may be positioned to cool a liquid positioned within the sealed cooling tank 17 of the lower casing 18. Alternatively, the convertible beverage dispenser 10 may be used in a second mode wherein the mechanical refrigeration system 19 is not utilized. In this second mode of operation, the cooling tank 17 within the lower casing 18 is filled only with ice particles which cool the beverage prior to being discharged from one of the dispensing valves 12, 14 or 16.

FIG. 3 illustrates a first mode in which the convertible beverage dispenser according to the present invention may be operated wherein a mechanical refrigeration system 19 is employed to cool a liquid positioned within the cooling tank 17 of the lower casing 18. The mechanical refrigeration system 19 includes a condensor 19C positioned on a plate 19P which forms a closure for the opening formed by the upwardly projecting walls of the cooling tank 17. On the lower surface of the plate 19P leg members 19L are attached which support the cooling coil 19L within the cooling tank 17.

The mechanical refrigeration system 19 may be easily removed from the casing 18 for servicing or storage. If this is desired, the leg members 19L are positioned directly on a surface and provide a support for the mechanical refrigeration system 19.

Four upwardly projecting walls form the side walls of the cooling tank 17. A cold plate forms the bottom surface which is preferrably formed as an aluminum casting which includes individual flow paths therethrough constructed of stainless steel tubing. The flow paths are provided for each of the individual beverages desired to be dispensed from the convertible beverage dispenser. The cold plate 17P is preferably directly welded or otherwise firmly fixed to the side walls to form a liquid-tight cooling tank 17. It is preferable to construct these side walls of aluminum so that no galvanic corrosion occurs between the cold plate and the side walls. Further, to insulate the cooling tank 17 a layer of insulating material, for example, Styrofoam, may be positioned directly adjacent to the side walls and the cold plate.

Figure 5:
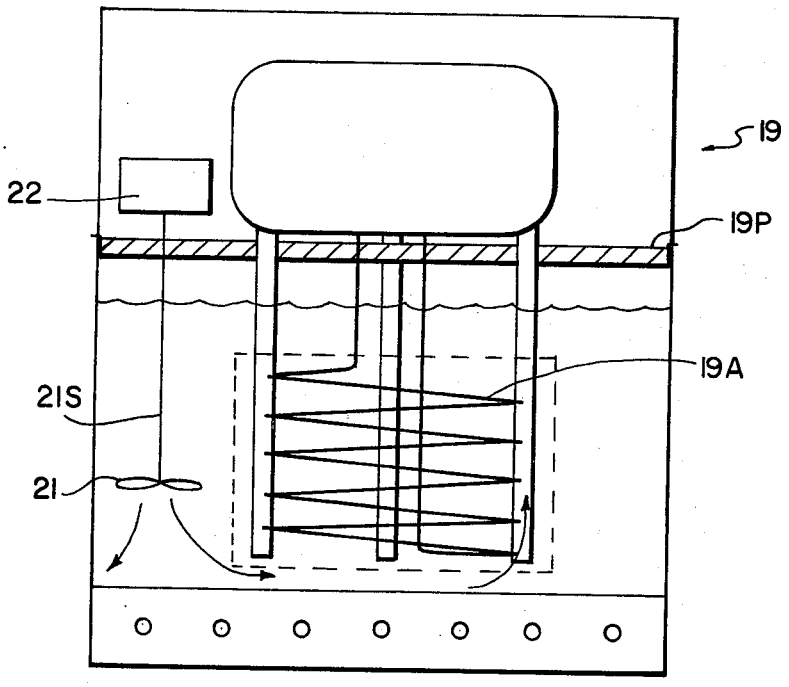
FIG. 5 is a schematic cross-sectional view of one embodiment of the present invention which includes a mechanical refrigeration system.

As illustrated in FIG. 5, the mechanical refrigeration system 19 is mounted directly on the top of the casing 18 and forms a closure for the cooling tank 17. A coil 19A projects downwardly from the mechanical refrigeration system 19 to cool the liquid within the cooling tank 17. Further, to aid in the circulation of the liquid within the cooling tank 17 an agitator 21 may be positioned therein to force the liquid around the coil 19A. The agitator 21 is mounted on a shaft 21S which is rotatably driven by a motor 22.

Figure 6:
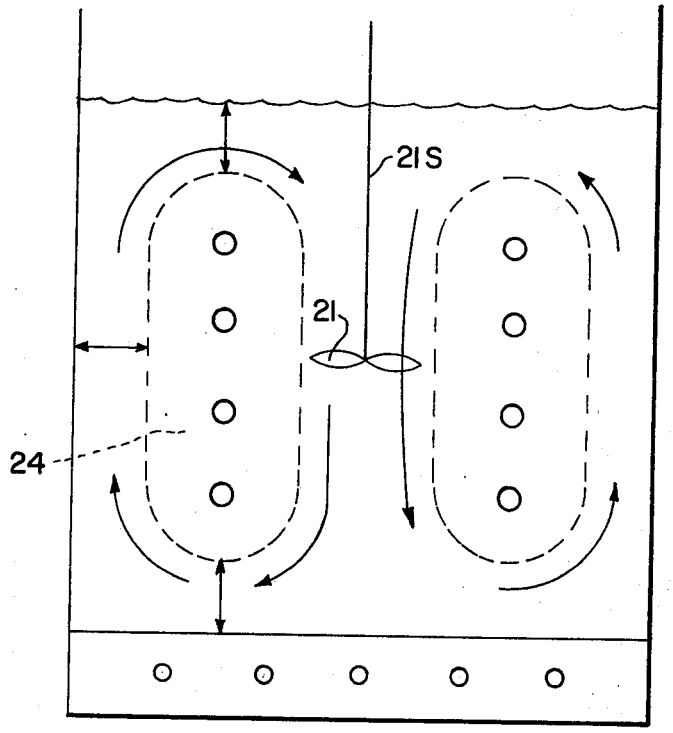
FIG. 6 is a schematic cross-sectional view of a preferred embodiment of the present invention which illustrates the arrangement of the cooling coil and an agitator of a mechanical refrigeration system.

The coil 19A is cooled to a temperature below 32° F. to form an ice bank around the coil. As illustrated in FIG. 6, the ice bank 24 will form around the coil leaving an open area centrally thereof. In this manner, liquid positioned within the cooling tank 17 may be directed through the center portion of the coil 19C by means of the agitator 21. An important aspect of the present invention is the spacing between the side walls and cold plate of the cooling tank 17 and the cooling coil 19C. It is important to adequately space the cooling coil from the side walls and the cold plate, so that the ice bank which forms therearound does not come into contact with the cold plate to produce a cold spot and thereby freeze a portion of the beverage contained within a flow path in the cold plate or heat exchanger 17P.

Figure 2:
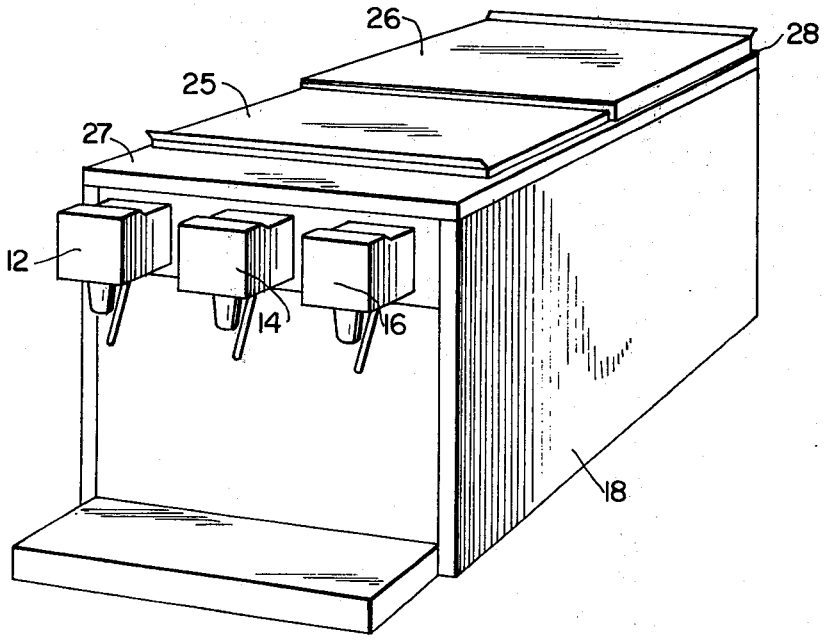
FIG. 2 is a perspective view of the convertible beverage dispenser according to the present invention wherein ice is used to cool the beverage to be dispensed.

As illustrated in FIGS. 2 and 4, the convertible beverage dispenser 10 according to the present invention may be employed in a second mode of operation. In this mode of operation, the mechanical refrigeration system 19 and the water is removed from the lower casing 18. Further, particles of ice only are positioned directly into the sealed cooling tank 17 to provide the refrigerant necessary to maintain the cold plate 17P at a desired temperature so as to cool the beverage flowing through the flow paths in the cold plate 17P which is subsequently dispensed from one of the dispensing valves 12, 14 or 16. In this mode of operation a cover 25, 26 which is normally removed from the lower casing 18 when the mechanical refrigeration system 19 is positioned on the lower casing 18, is now positioned on the lower casing 18 to close the top opening of the cooling tank 17. It should be noted that ice particles are positioned in the cooling tank 17 through the opening which may be closed by the cover 25, 26. In this mode, the tank (plate) drain is opened to provide good melt water drainage.

In the preferred embodiment of the present invention the side walls of the cooling tank 17 are formed of aluminum so that galvanic corrosion does not occur between the side walls and the cold plate 17P. However, the side walls of the cooling tank 17 may be constructed of stainless steel which would similarly be attached to the cold plate 17P so as to form a liquid-tight cooling tank 17.

A frame member 27 is positioned adjacent the upper portion of the lower casing 18 and forms a support onto which the mechanical refrigeration system 19 is positioned. As illustrated in FIG. 2, the frame 27 includes a flange 28 which extends adjacent the upper surface of the lower casing 18 and is designed to mate with the flange member 29 of the mechanical refrigeration system 19.

The convertible beverage dispenser according to the present invention is quite an improvement over the beverage dispensers disclosed in the prior art since the lower casing 18 is designed to be operated independently of the mechanical refrigeration system 19. By constructing the cooling tank 17 as a liquid-tight compartment with the cold plate 17P forming the bottom, ice alone will provide the refrigeration for the cold plate 17P which cools the beverage flowing therethrough before being discharged from the dispensing valves 12, 14 or 16. This combination is quite an improvement over prior art beverage dispensing devices since it can readily be used with a mechanical refrigeration system using a water bath or with ice particles alone. In contrast thereto, the prior art beverage dispensing systems are designed to be used solely with a mechanical refrigeration system as a means of refrigerating the beverage to be dispensed or are designed to be used solely with ice particles to provide the refrigeration necessary to cool the beverage to be dispensed. No prior art beverage dispensers disclose a convertible device which may be readily used with a mechanical refrigeration system or, in the alternative, with ice particles only while still employing the same lower casing which includes a cooling tank with a sealed heat transfer plate forming the bottom thereof through which the beverage flows from the individual beverage containers through the sealed heat transfer plate to a dispensing valve from which the beverage is discharged.

The coil 19A connected to the condensor 19C is preferrably constructed of copper which may set up a galvanic cell when positioned in the water bath contained in the cooling tank 17. To overcome this problem, the coil 19A may be coated with an epoxy coating to prevent the formation of a galvanic cell which would lead to galvanic corrosion. The coating of the coil 19A with epoxy does not deter from the performance of the mechanical refrigeration system. In addition, the coil 19A may be constructed of aluminum, to avoid the formation of a galvanic cell.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A convertible cooling system for a post-mix or pre-mix beverage dispenser for cooling at least one beverage product which is supplied from a beverage container through the cooling system to a discharge valve comprising:

a cooling tank in which a refrigeration means is positioned for cooling the beverage product, said cooling tank including four upwardly projecting sidewalls terminating in an open top portion;

a heat transfer plate positioned in the cooling tank forming an integral bottom portion thereof and being sealably affixed to said four upwardly projecting sidewalls to form a liquid-tight compartment, said heat transfer plate including a plurality of flow paths therethrough in communication with said beverage product and said discharge valve; and a removable mechanical refrigerating means for cooling said beverage within said flow paths to a predetermined temperature including a coil which projects into said cooling tank a predetermined distance while providing an adequate spacing from said heat transfer plate wherein an ice bank forming on said coil is maintained out of contact with said heat transfer plate to prevent cold spots and freezing of a portion of the beverage contained within said flow paths within said heat transfer plate, said removable mechanical refrigerating means including a plate for providing a closure to said open top portion of said cooling tank;

said removable mechanical refrigerating means including downwardly projecting legs for providing a support when removed from the cooling tank and further including an agitator rotatably driven by a motor for circulating liquid within said cooling tank;

whereby said mechanical refrigerating means may be readily removed from said cooling tank and ice particles positioned directly on said heat transfer plate thereby providing the refrigeration means for cooling said beverage to said predetermined temperature.

2. A convertible cooling system according to claim 1, wherein said heat transfer plate is an aluminum casting plate with flow paths positioned therein.

3. A convertible cooling system according to claim 1, wherein three beverage flow paths are disposed within said heat transfer plate.

4. A convertible cooling system according to claim 1, wherein said beverage dispenser includes at least three beverage dispensing valves.

* * * * *